United States Patent [19]

Gezels

[11] Patent Number: 5,057,350

[45] Date of Patent: Oct. 15, 1991

[54] PALLET CHOCK

[75] Inventor: Jean-Marie Gezels, Pekelharing 35, 9000 Gent, Belgium

[73] Assignees: Jean-Marie J. Gezels, Gent, Belgium; Richard Leen, Mol, Belgium

[21] Appl. No.: 565,365

[22] Filed: Aug. 10, 1990

[30] Foreign Application Priority Data

Aug. 10, 1989 [BE] Belgium ..... 8900860

[51] Int. Cl.[5] ..... B32B 3/26

[52] U.S. Cl. ..... 428/138; 108/51.1; 108/901; 248/188.8; 428/36.5; 428/119; 428/188; 428/319.7

[58] Field of Search ..... 428/36.5, 119, 120, 428/71, 138, 188, 319.3, 319.7; 108/51.1, 901; 220/444, 902; 248/188.8

[56] References Cited

U.S. PATENT DOCUMENTS 3,697,029 10/1972 Lauffer ..... 428/319.7

4,565,723 1/1986 Hirsch ..... 428/119

4,874,649 10/1989 Daubenbüchel ..... 428/36.5

FOREIGN PATENT DOCUMENTS 0156750 10/1985 European Pat. Off. .

3632062 3/1988 Fed. Rep. of Germany .

6915105 4/1970 Netherlands .

7210450 2/1973 Netherlands .

1365582 9/1974 United Kingdom .

*Primary Examiner*—William J. Van Balen

*Attorney, Agent, or Firm*—Foley & Lardner

[57] ABSTRACT

Pallet chock formed of at least two types of synthetic materials namely a compact synthetic material (6) which forms the outer layer, and a foamed synthetic material (7) which provides a filling, whereby the unit is obtained because during the manufacturing the synthetic material (7) which provides the filling is injected immediately after the compact synthetic material (6) into the matrix in which the pallet chock (4) is manufactured.

10 Claims, 2 Drawing Sheets

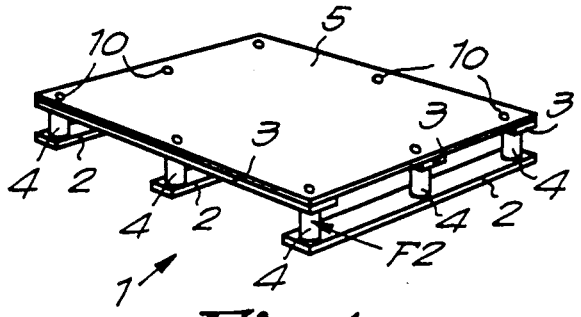
Fig. 1
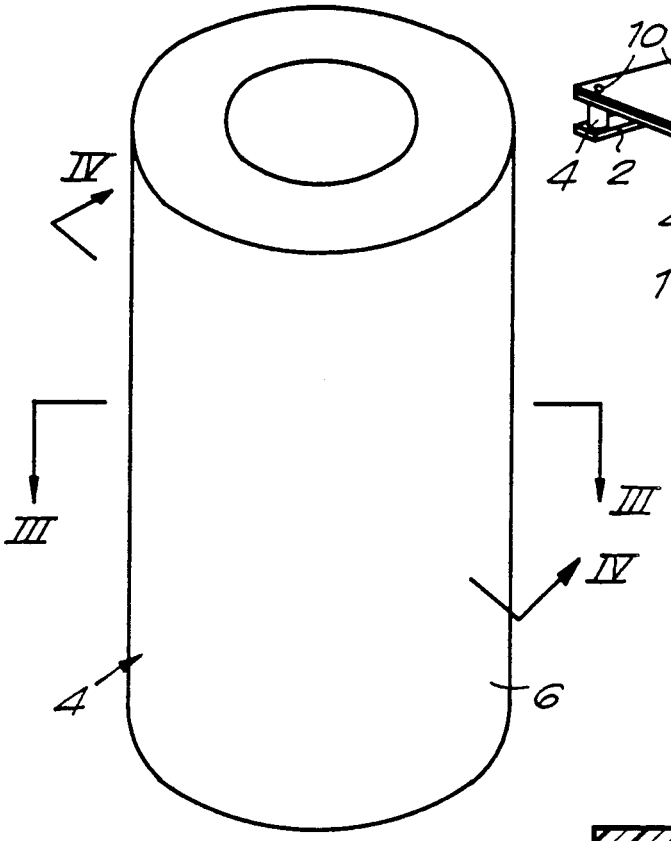
Fig. 2
Fig. 3
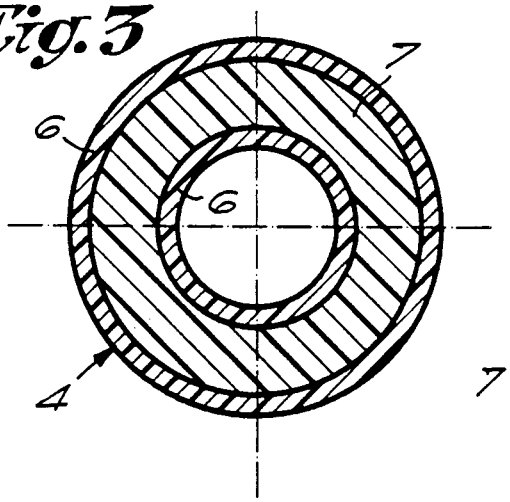
Fig. 4
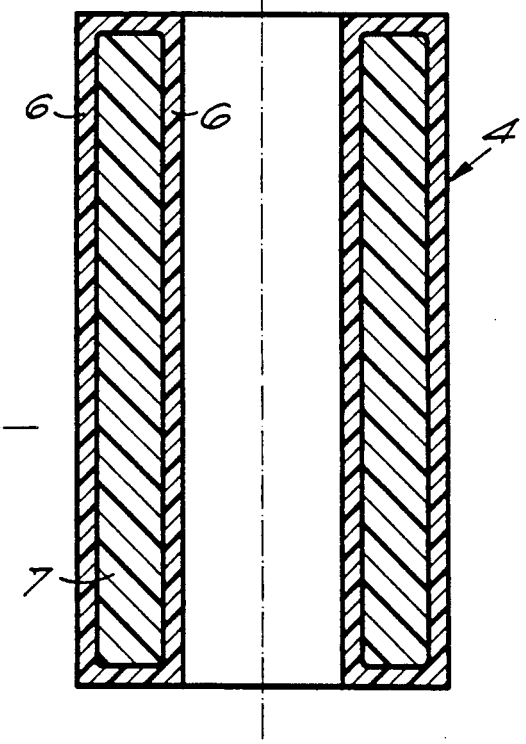

PALLET CHOCK

BACKGROUND OF THE INVENTION

1. Field of the Invention

This invention relates to pallet chocks, in other words intermediate chocks which are intended to be installed between the intermediate and under planks of pallets.

2. Relevant Art

It is known that wooden pallets, on the market at present, are provided with intermediate blocks or chocks in wood which are nailed to the upper deck and the under planks. With the use of these pallets it occurs, that with rough handling the pallet chocks tear away from the planks, through which the nails then protruding constitute a serious danger for the goods and for the workers. Furthermore the repair of such pallet chocks is a rather laborious occupation.

Because of the aforementioned reasons there is therefore a great demand for safe and reliable pallets, with pallet chocks which can easily be replaced in case of damage. An improvement in this field consists in that the classic wooden pallet chocks are replaced by pallet chocks synthetic material which, because of economic reasons, are made from recycled material. The fact that recycled material is used has the disadvantage that these pallet chocks only have a limited strength. The manufacture of such pallet chocks in solid form from classic synthetic material of good quality offers no practical solution, because this would lead to a particularly high cost price.

OBJECTS AND SUMMARY OF THE INVENTION

This invention relates to a pallet chock, which with its application in pallets does not show the aforementioned disadvantages. For this purpose it is so manufactured that it is notably stronger than a pallet chock made of recycled material or out of wood, and that the cost/price is economically sound, in other words is notably less than if the pallet chock were only be manufactured from a classic solid synthetic material.

For this purpose the invention consists of a pallet chock, with as characteristics that it is formed of at least two types of synthetic material, namely a compact synthetic material which forms the outer layer, and a foamed synthetic material which provides a filling, whereby the unit is obtained because during the manufacturing the synthetic material which provides the filling is injected immediately after the compact synthetic material into the matrix in which the pallet chock is manufactured.

The use of the foamed synthetic material, through which as it were a cellular structure arises, offers the advantage that a smaller amount of solid synthetic material needs to be applied wherein the cost/price of the pallet chock remains relatively small. Through the fact that the outside remains of solid material, the pallet chock is notably more resistant against knocks than is the case with wooden pallet chocks.

In its simplest form the pallet chock is manufactured cylindrically.

In the most preferable embodiment the pallet chock is nearly cubiform and shows two diagonally placed through going openings which allow the attachment of the pallet chock at two locations by means of through going tubular elements which at the same time extend through the under and intermediate planks and possibly the pallet board and are there attached in an arbitrary manner, for example by folding over the edges. Apart from that, a groove is formed in the pallet chock according to the other diagonal direction, through which a relatively large saving of material is achieved without the strength suffering as a result of this.

BRIEF DESCRIPTION OF THE DRAWINGS

In order to better show the characteristics according to the present invention, some preferred embodiments are described hereafter, as examples without any restrictive character, with reference to the enclosed drawings, in which:

FIG. 1 shows a pallet in which pallet chocks according to the invention are applied;

FIG. 2 shows a view of a pallet chock from the pallet from FIG. 1, more especially according to arrow F2 in FIG. 1;

FIGS. 3 and 4 show sections respectively according to lines III—III and IV—IV in FIG. 2;

DETAILED DESCRIPTION OF THE INVENTION

Figure 5:
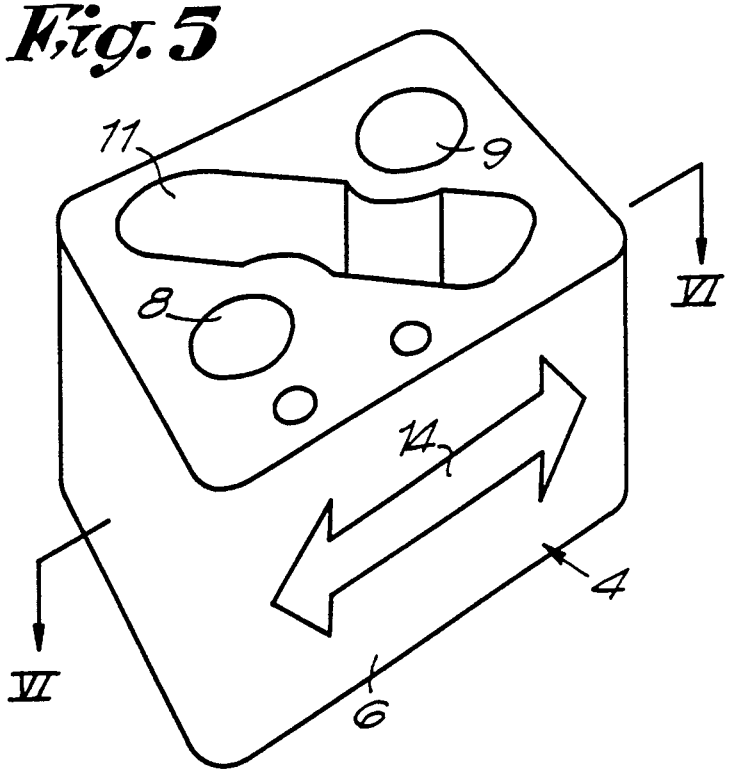
FIG. 5 shows another pallet chock according to the invention.

As shown in FIG. 1 a pallet 1 generally consists of under planks 2, intermediate planks 3 between which pallet chocks 4 are installed and on which a loading surface or upper deck 5 is provided.

The present invention concerns the aforementioned pallet chocks 4, with as characteristics that as are shown in FIGS. 2 through 4, they are formed of at least two types of synthetic material, namely a compact synthetic material 6 which forms the outer layer, and a foamed synthetic material 7 which provides a filling, whereby the unit is obtained because during the manufacturing the foamed synthetic material 7 is injected immediately after the compact synthetic material 6 into the matrix in which the pallet chock 4 is manufactured.

The compact synthetic material 6 is hereby pressed against all walls in the matrix by the foamed synthetic material 7, whereby the foamed synthetic material 7 still takes up all available space in a cellular state, since during the heating with the injection a gas is liberated in the foamed synthetic material 7 through which the latter, as it were, inflates. The formed cells can be microscopically small.

The compact synthetic material 6 preferably consists of a copolymer, while the foamed synthetic material 7 consists of a homopolymer, through which a unit is obtained that is particularly suitable for pallet chocks 4. In the preferable embodiment the outer layer consists of synthetic material 6 based on polypropylene, while the filling consists of synthetic material 7 based on polypropylene to which a foaming agent is added.

In the simplest embodiment the pallet chock 4 is produced cylindrically, as shown in FIGS. 2 through 4.

In a particular embodiment they are also produced cubiform or almost cubiform, whereby two diagonally placed through going openings 8 and 9 are provided, as shown in FIG. 5, through which a particularly strong attachment of the pallet chock 4 to the other pallet parts is possible by means of tubular elements 10 or similar which pass through the openings 8 and 9, as well as through the under planks and upper planks, where they are folded over for example. Also the pallet chock from FIG. 4 can be attached in such a manner.

Preferably a diagonally extending notch 11 is formed at the same time in the pallet chock 4 from FIG. 5. This offers the advantage that a relatively large saving of material is achieved and that the pallet chock 4 is strengthened to a certain extent, because of the fact due to this diagonal ribs 12 and 13 are formed which consist of the compact synthetic material 6 which is notably stronger than the foamed synthetic material 7.

Figure 6:
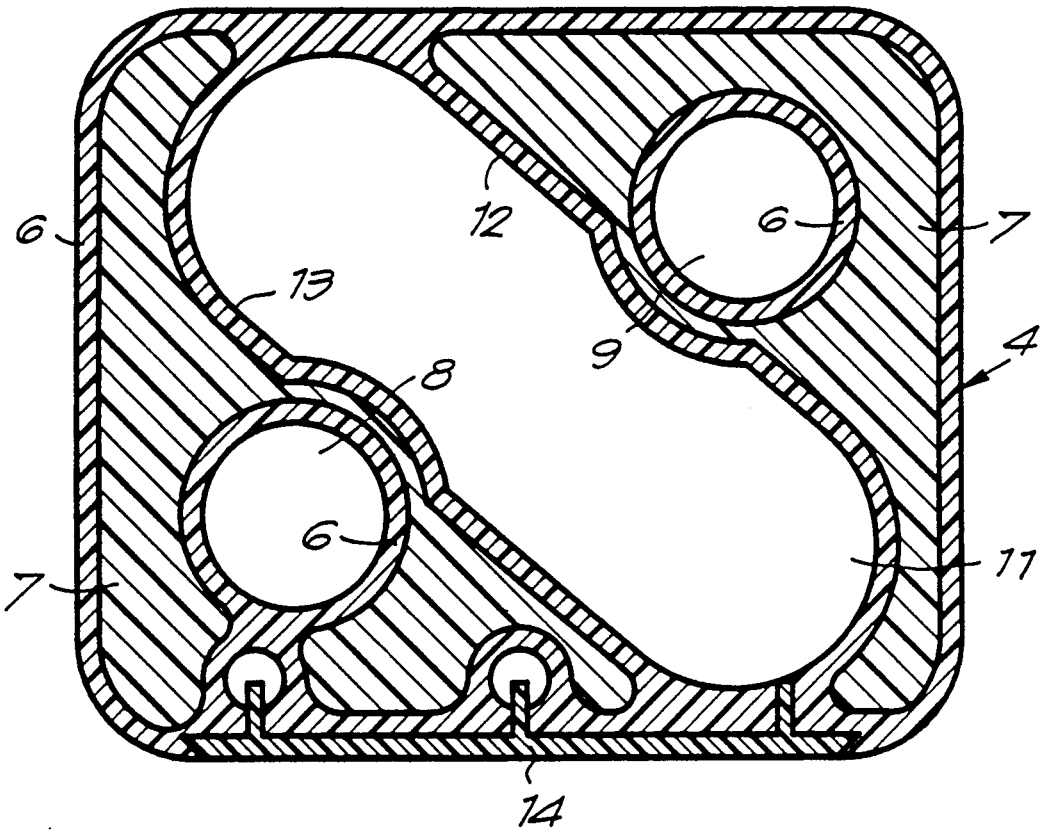
FIG. 6 shows a section according to line VI—VI in FIG. 5.

As shown in FIGS. 5 and 6 accessories, such as elements 14 produced in the form of drawings and inscriptions, can be cast in the pallet chock 4 or otherwise, with as advantage that the compact synthetic material 6 entirely surrounds these elements 14 on the inside of the matrix, through which the attachment of these elements 14 is therefore not weakened by the presence of the foamed synthetic material 7.

It is clear that in practise the compact synthetic material 6 and the foamed synthetic material 7 more or less gradually merge into each other and form a solid structure.

The present invention is in no way restricted to the embodiments described as examples and shown in the figures, but such pallet chock can be implemented in all kinds of forms and dimensions without departing from the scope of the present invention.

I claim:

1. A pallet chock comprising an outer layer of compact synthetic material (6) and an inner, filler material of foamed synthetic material (7), formed by the process of injecting the filler material (7) immediately after the injection of the compact synthetic material (6) into a matrix in which the pallet chock (4) is formed.

2. A pallet chock according to claim 1 including pressing the compact synthetic material against matrix walls by the filler material (7).

3. A pallet chock according to claim 2 including heating the foamed synthetic material with a injection gas liberated in the foamed synthetic material (7).

4. A pallet chock according to claim 1 including casting accessory elements (14) on the pallet chock (4).

5. Pallet chock according to claim 1 wherein: the compact synthetic material (6) comprises a copolymer.

6. Pallet chock according to claim 1 wherein: the foamed synthetic material (7) comprises a homopolymer.

7. Pallet chock according to claim 1 wherein the compact synthetic material (6) comprising a synthetic material based on polypropylene, while the foamed synthetic material (7) comprising a synthetic material based on polypropylene and a foaming product.

8. Pallet chock according to claim 1, wherein the chock (4) is cylindrical.

9. Pallet chock according to claim 1, wherein the chock (4) is substantially cubiform and has two diagonally placed through going openings (8, 9) for the attachment thereof in a pallet (1).

10. Pallet chock according to claim 6, further comprising a notch (11) situated in a second diagonal direction.

* * * * *